US009430896B2

(12) United States Patent
Fujiwara et al.

(10) Patent No.: US 9,430,896 B2
(45) Date of Patent: Aug. 30, 2016

(54) BILL HANDLING APPARATUS

(71) Applicant: FUJITSU FRONTECH LIMITED, Tokyo (JP)

(72) Inventors: Ryo Fujiwara, Inagi (JP); Ryosuke Ebinuma, Inagi (JP); Shohei Koizumi, Inagi (JP); Koichi Hosoyama, Inagi (JP); Hiroshi Yanagida, Inagi (JP)

(73) Assignee: FUJITSU FRONTECH LIMITED, Inagi-Shi, Tokyo (JP)

( * ) Notice: Subject to any disclaimer, the term of this patent is extended or adjusted under 35 U.S.C. 154(b) by 0 days.

(21) Appl. No.: 14/627,111

(22) Filed: Feb. 20, 2015

(65) Prior Publication Data

US 2015/0279145 A1 Oct. 1, 2015

(30) Foreign Application Priority Data

Mar. 28, 2014 (JP) ..... 2014-069990

(51) Int. Cl.

| | |
|---|---|
| ***G07F 7/04*** | (2006.01) |
| ***G07D 11/00*** | (2006.01) |
| ***G07D 7/00*** | (2016.01) |

(52) U.S. Cl.

CPC ..... *G07D 11/0084* (2013.01); *G07D 7/00* (2013.01); *G07D 11/0021* (2013.01); *B65H 2404/261* (2013.01); *B65H 2701/1912* (2013.01); *G07D 2211/00* (2013.01)

(58) Field of Classification Search

CPC ..... B65H 23/02; B65H 23/22; B65H 47/00; B65H 2404/261; B65H 2701/1912; G07D 7/00; G07D 11/0021; G07D 2211/00

USPC ..... 104/206

See application file for complete search history.

(56) References Cited

U.S. PATENT DOCUMENTS

| | | | | |
|---|---|---|---|---|
| 4,854,452 | A * | 8/1989 | Uchida | B65H 29/40 194/206 |
| 7,422,118 | B2 * | 9/2008 | Ugo et al. | 209/534 |
| 2001/0022258 | A1 * | 9/2001 | Satou et al. | 194/206 |
| 2004/0182677 | A1 * | 9/2004 | Katou et al. | 194/206 |

FOREIGN PATENT DOCUMENTS

| | | |
|---|---|---|
| JP | 05-178531 | 7/1993 |
| JP | 06-080282 | 3/1994 |
| JP | 2009-179484 | 8/2009 |
| JP | 2009-238090 | 10/2009 |

* cited by examiner

*Primary Examiner* — Mark Beauchaine

(74) *Attorney, Agent, or Firm* — Staas & Halsey LLP

(57) ABSTRACT

A bill handling apparatus includes a first squeezing unit that performs a first squeezing of a bill in receiving the bill, and a second squeezing unit that performs a second squeezing of the bill after the first squeezing, wherein the first squeezing unit comprises a pair of conveying belts that convey the bill in a predetermined conveying direction in receiving the bill, a distance between both the conveying belts being gradually reduced in a direction of thickness of the bill in the predetermined conveying direction, and the second squeezing unit comprises a pair of rollers disposed at an end part of the first squeezing unit in the predetermined conveying direction.

3 Claims, 2 Drawing Sheets

BILL HANDLING APPARATUS

CROSS-REFERENCE TO RELATED APPLICATION

This application is based upon and claims the benefit of priority of the prior Japanese Patent Application No. 2014-069990, filed on Mar. 28, 2014, the entire contents of which are incorporated herein by reference.

FIELD

The embodiment discussed herein is related to a bill handling apparatus.

BACKGROUND

A bill recycle unit that receives and dispenses a bill is equipped with a bill validator (hereinafter abbreviated to "BV") that validates bill species, a serial number of the bill, and authenticity of the bill. Various sensors such as an image sensor that reads an image of the bill, and a magnetic sensor that detects a magnetic pattern of the bill are provided within BV for bill validation purpose.

Related-art examples are described, for example, in Japanese Laid-open Patent Publication No. 2009-238090

Various sensors within BV are in many cases disposed close to the surface of the bill, and, thus, in the direction of the thickness of the bill, the width of a conveying path within BV is particularly smaller than that of other conveying path within a bill recycle unit. For this reason, when a folded bill and a bent bill are conveyed to BV, jam is likely to occur within BV. When jam occurs within BV, in order to remove the bill that caused jamming from within BV, the operation of the bill recycle unit should be stopped, disadvantageously leading to the stop of account activity.

SUMMARY

According to an aspect of an embodiment, a bill handling apparatus includes a first squeezing unit that performs a first squeezing of a bill in receiving the bill, and a second squeezing unit that performs a second squeezing of the bill after the first squeezing, wherein the first squeezing unit comprises a pair of conveying belts that convey the bill in a predetermined conveying direction in receiving the bill, a distance between both the conveying belts being gradually reduced in a direction of thickness of the bill in the predetermined conveying direction, and the second squeezing unit comprises a pair of rollers disposed at an end part of the first squeezing unit in the predetermined conveying direction.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENT

Figure 1:
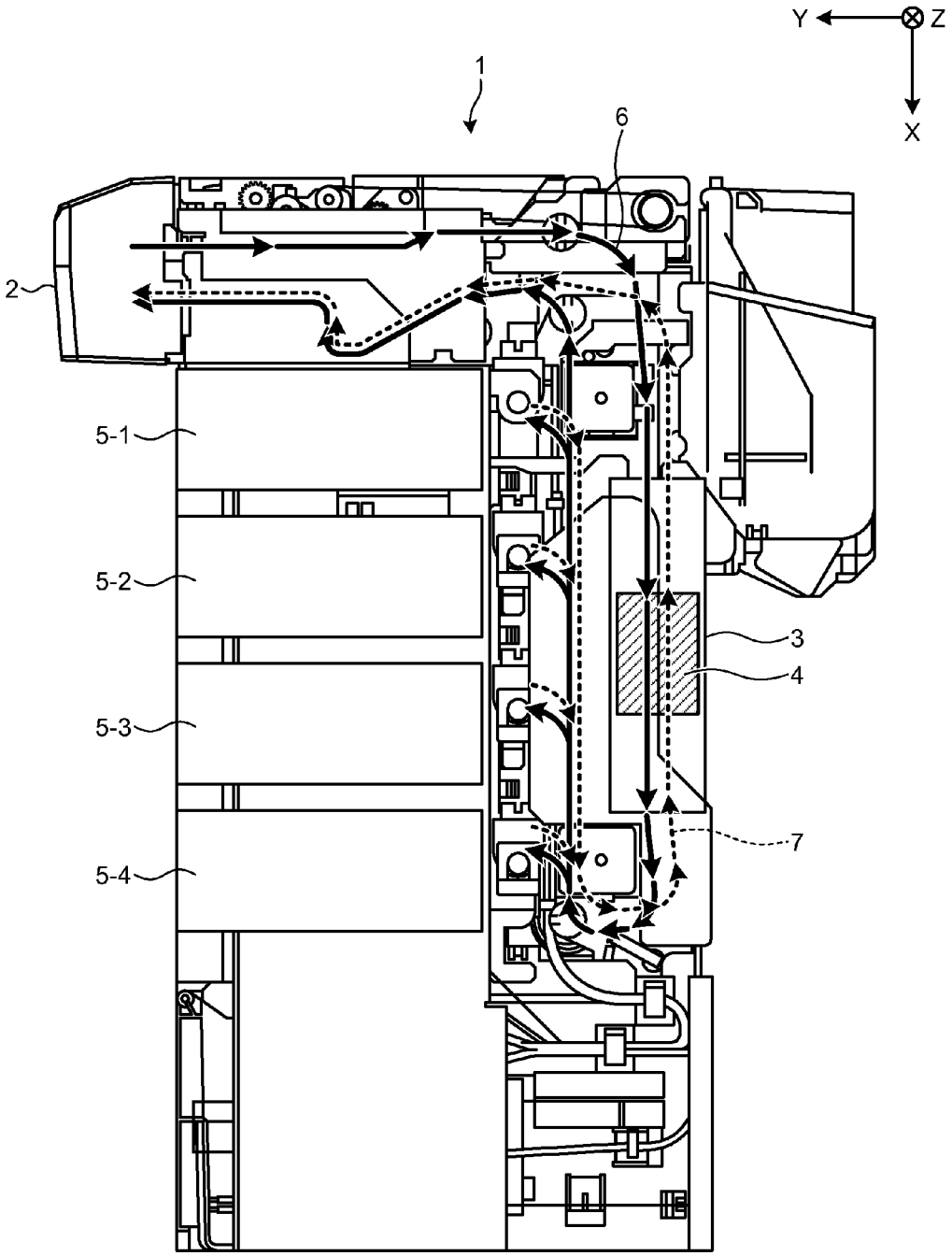
FIG. 1 is a side cross-sectional view of a bill recycle unit in an embodiment.

The preferred embodiment of the present invention will be explained with reference to accompanying drawings.

Note that the embodiment does not limit the bill handling apparatus disclosed in the present application . In the following embodiment, like parts are identified with the same reference characters, and the overlapped explanation thereof will be omitted. The bill handling apparatus that will described below are loaded, for example, on a bill recycle unit.

Structure of Bill Recycle Unit

FIG. 1 is a side cross-sectional view of a bill recycle unit in an embodiment. A bill recycle unit 1 illustrated in FIG. 1 includes a bill handling apparatus 3. The bill handling apparatus 3 includes BV 4.

In the bill recycle unit 1, in receiving bills, the bill that have been received through a bill receiving/dispensing port 2 are passed through a received bill conveying path 6, are conveyed to the BV 4 within the bill handling apparatus 3, and are validated by the BV 4. The bill that is not false, could have been subjected to determination of billing species and serial numbers with acceptable results, and have been validated to be valid are discharged from the BV 4, are introduced into and stored in any of recycle stackers 5-1 to 5-4 depending upon bill species. For example, the recycle stacker 5-1 stores 10,000 yen bills, the recycle stacker 5-2 stores 5,000 yen bills, and the recycle stacker 5-3 stores 1,000 yen bills. On the other hand, the bill, when received, of which the species could not have successfully been validated by the BV 4 and the validation result is invalid, are not stored in the recycle stackers 5-1 to 5-4 and as such are returned to the bill receiving/dispensing port 2.

Bills that, when dispensed, are stored in the recycle stackers 5-1 to 5-4 are passed through a bill dispensing conveying path 7, are conveyed to the BV 4 within the bill handling apparatus 3, and are validated by the BV 4. The bill that has been determined to be valid is discharged from the BV 4, are then conveyed to the bill receiving/dispensing port 2, and are dispensed. On the other hand, when dispersed, the bill which has been determined to be invalid is conveyed and stored in a predetermined box (not shown) within a bill recycle unit.

Structure of Bill Handling Apparatus

Figure 2:
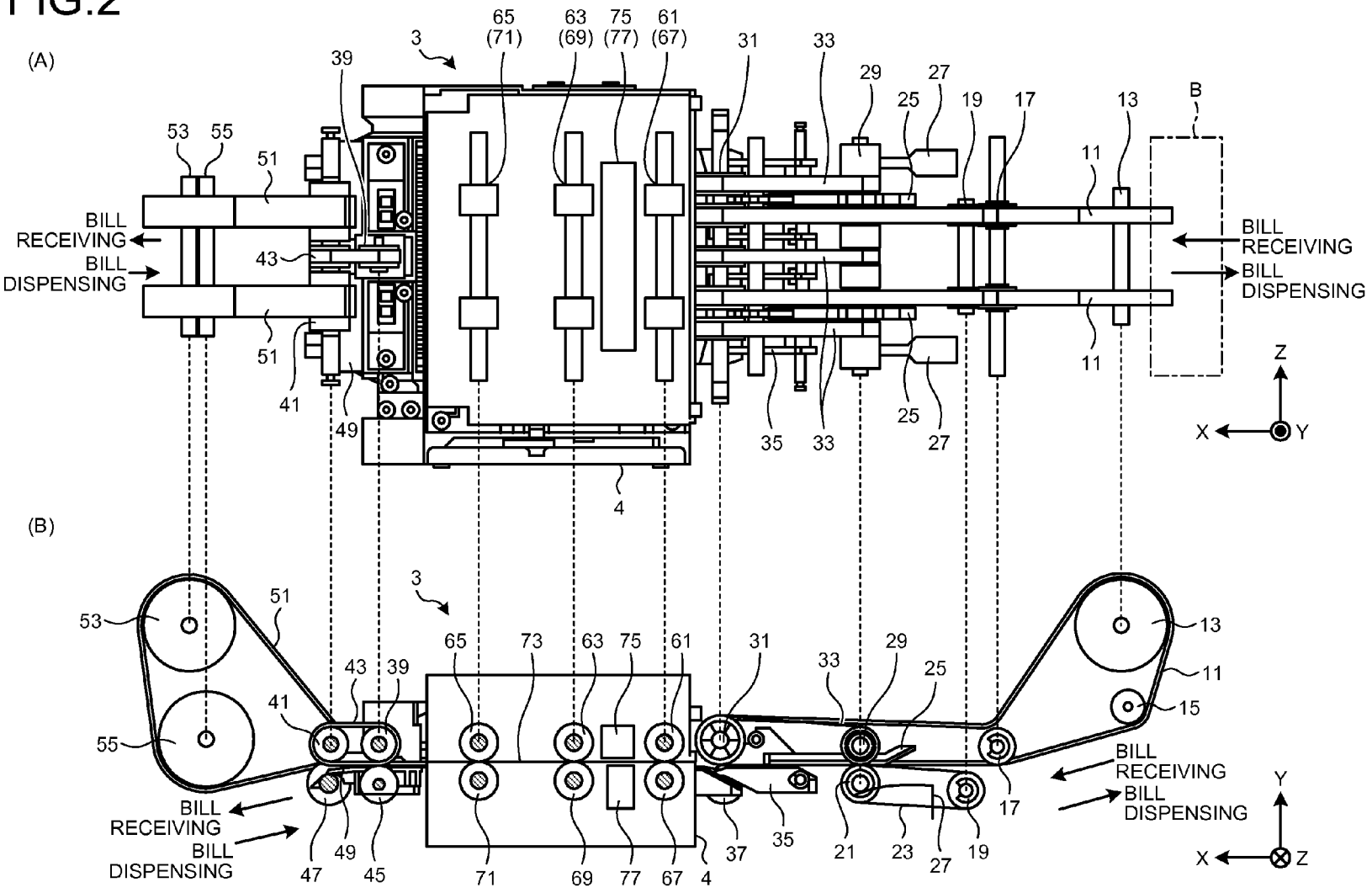
FIG. 2 is a diagram illustrating an internal structure of a bill handling apparatus in an embodiment.

FIG. 2 is a diagram illustrating an internal structure of a bill handling apparatus in an embodiment, wherein FIG. 2(A) is a top view, and FIG. 2(B) is a side view. In a bill B, the longitudinal direction is regarded as a Z-axis direction, and the lateral direction is regarded as an X-axis direction. The bill B, when received, is conveyed in +X direction and, when dispensed, is conveyed in −X direction.

In the bill handling apparatus 3 illustrated in FIG. 2, on an inlet side of the BV 4 in receiving bills (that is, on an outlet side of the BV 4 in dispensing bills), a conveying belt 11 is extended over a conveying roller 13, a pressure roller 31, a conveying roller 17, and a conveying roller 15. A conveying belt 23 is extended over a conveying roller 19 and a squeezing roller 21. A conveying belt 33 is extended over a squeezing roller 29 and the pressure roller 31.

On an inlet side of the BV 4 in receiving bills, a conveying guide 25 that guides the bill B in receiving into between the squeezing roller 29 and the squeezing roller 21 is disposed near the squeezing roller 29. The right end of the conveying guide 25 is in such a shape that is open to an upper direction perpendicular to the conveying path (+Y direction). The right end of the conveying guide 25 is located at a position between the squeezing roller 29 and the conveying roller 17 and just before the squeezing roller 29. A conveying guide 35 that guides the bill B in receiving into between the pressure roller 31 and a conveying roller 37 is disposed between the squeezing roller 21 and the conveying roller 37.

Further, a plate spring 27 that presses the squeezing roller 21 against the squeezing roller 29 is installed by being supported on a casing (not illustrated) in the bill handling apparatus 3.

In receiving bills, the bill B is conveyed along the conveying belt 11 into the BV 4 when the conveying rollers 13, 15, 17, the squeezing roller 29 and the pressure roller 31 are rotated clockwise while the conveying roller 19, the squeezing roller 21, and the conveying roller 37 are rotated counterclockwise. That is, in receiving bills, the bill B is held between the conveying belt 11 and the conveying belt 23 and is conveyed into a left direction (+X direction). Thereafter, the bill B is conveyed between the conveying belt 11 and the conveying guide 35 by the conveying belts 11, 33 in a left direction and is conveyed into the BV 4.

In dispensing bills, the bill B discharged from the BV 4 is conveyed along the conveying belt 11 towards the bill receiving/dispensing port 2 when the conveying rollers 13, 15, 17, the squeezing roller 29, and the pressure roller 31 are rotated counterclockwise while the conveying roller 19, the squeezing roller 21, and the conveying roller 37 are rotated clockwise. That is, in dispensing bills, the bill B discharged from the BV 4 is conveyed between the conveying belt 11 and the conveying guide 35 in a right direction (−X direction) by the conveying belts 11, 33. Thereafter, the bill B is held between the conveying belt 11 and the conveying belt 23, and is conveyed in the right direction.

On an outlet side of the BV 4 in receiving bills (that is, on an inlet side of the BV 4 in dispensing bills), a conveying belt 43 is extended over a conveying roller 39 and a conveying roller 41, and a conveying belt 51 is extended over the conveying roller 41, a conveying roller 53, and a conveying roller 55. Further, a conveying guide 49 that guides the bill B in dispensing bills into between the conveying roller 39 and a squeezing roller 45 is disposed near the squeezing roller 45.

In receiving bills, the bill B discharged from the BV 4 is conveyed in a left direction along the conveying belts 43, 51 by rotating the conveying rollers 39, 41, 53, 55 clockwise while the squeezing rollers 45, 47 are rotated counterclockwise.

In dispensing bills, the bill B is conveyed along the conveying belts 51, 43 into the BV 4 by rotating the conveying rollers 39, 41, 53, 55 counterclockwise while the squeezing rollers 45, 47 are rotated clockwise.

In the BV 4, the conveying path 73 is provided, and a pair of conveying rollers 61,67, a pair of conveying rollers 63, 69, and a pair of conveying rollers 65, 71 are disposed with the conveying path 73 being located between conveying rollers constituting the conveying roller pairs. Sensors 75, 77 are disposed with the conveying path 73 being located between the sensors 75, 77. In receiving bills, the bill B is conveyed in a left direction (+X direction) on the conveying path when the conveying rollers 61, 63, 65 are rotated clockwise while the conveying rollers 67, 69, 71 are rotated counterclockwise. In dispensing bills, the bill B is conveyed in a right direction (−X direction) on the conveying path when the conveying rollers 61, 63, 65 are rotated counterclockwise while the conveying rollers 67, 69, 71 are rotated clockwise. Examples of sensors 75, 77 include image sensors and magnetic sensors. For example, reading of an image of the bill B and the detection of a magnetic pattern of the bill B are carried out in both the receipt of the bill B and the dispensing of the bill B. In the BV 4, the bill B is validated based on the image read and the detected magnetic pattern with the sensors 75, 77.

Operation of Bill Handling Apparatus

An operation in receiving bills and an operation in dispensing bills will be described separately from each other.

Operation in Receiving Bills

As illustrated in FIG. 2(B), the distance between the conveying belt 11 and the conveying belt 23 that constitute a pair of belts in a Y-axis direction (that is, in a direction of the thickness of the bill B) is gradually reduced from the conveying roller 19 towards the squeezing roller 21. That is, the conveying path defined by the conveying belt 11 and the conveying belt 23 is gradually narrowed in a conveying direction of the bill B in receiving bills. In receiving bills, since the bill B is conveyed in a left direction (+X direction) while being held between the conveying belt 11 and the conveying belt 23, the "first-stage squeezing" in receiving bills is carried out against the bill B in receiving bills by the gradually narrowed conveying path. That is, the gradually narrowed conveying path corresponds to a "first squeezing unit" that performs a "first-stage squeezing" against the bill B in receiving bills. In the direction of X-axis, the conveying belt 11 and the conveying belt 23 come into contact with each other at a position near an approximate center of the cross section of the squeezing roller 21 and the squeezing roller 29. Thus, the conveying path that is gradually narrowed in +X direction is terminated at a position near an approximate center of the cross section of the squeezing roller 21 and the squeezing roller 29.

Squeezing rollers 21, 29 that constitute a pair of rollers are disposed at an end part of the conveying path that is defined by the conveying belt 11 and the conveying belt 23 and is gradually narrowed. Thus, the bill B that has been subjected to the first-stage squeezing by the conveying path that is defined by the conveying belt 11 and the conveying belt 23 and is gradually narrowed is guided by the conveying guide 25 into between the squeezing roller 21 and the squeezing roller 29 and is pressed while being held between the squeezing roller 21 and the squeezing roller 29 for "second-stage squeezing." That is, the squeezing roller 21 and the squeezing roller 29 correspond to the "second squeezing unit" that performs "second-stage squeezing" against the bill B in receiving bills.

Here in a longitudinal direction perpendicular to the conveying direction of the bill B, the area of contact between each of the squeezing rollers 29, 21 and the bill B is extended over a substantially entire area in the longitudinal direction of the bill B. For example, in the longitudinal direction, the length of contact between each of the squeezing rollers 29, 21 and the bill B is preferably set 80% or more of the length in the longitudinal direction of the bill B. Further, the squeezing roller 21 is pressed against the squeezing roller 29 by the plate spring 27. Thus, the bill B in receiving bills is reliably squeezed by the second-stage squeezing. Further, the pressure of the second-stage squeezing against the bill B in receiving bills is larger than the pressure of the first-stage squeezing. That is, the bill B that has been gradually squeezed by the conveying path that is defined by the conveying belt 11 and the conveying belt 23 and is gradually narrowed is further strongly squeezed by the squeezing rollers 29, 21.

The bill B that has been subjected to the first-stage squeezing and second-stage squeezing is further conveyed in a left direction (+X direction) and is guided by the conveying guide 35 into between the pressure roller 31 and the conveying roller 37 that constitute a pair of rollers. The bill B is then held between the pressure roller 31 and the conveying roller 37 and, in this state, is pressed for a "third-stage squeezing." That is, the pressure roller 31 and the conveying roller 37 correspond to a "third squeezing unit" that performs the "third-stage squeezing" against the bill B in receiving bills.

Thus, in the bill handling apparatus 3, the bill B in receiving bills is conveyed into the BV 4 after the first- to third-stage squeezing. Therefore, the bill B in receiving bills when conveyed into the BV 4 is in the state of being flatly shaped by the first- to third-stage squeezing. That is, when folding is present in the bill B before the entry into the gradually narrowed conveying path defined by the conveying belt 11 and the conveying belt 23, the bill B is first subjected to the first-stage squeezing by the gradually narrowed conveying path. Next, the bill B after the first-stage squeezing is subjected to the second-stage squeezing by the squeezing roller 21 and the squeezing roller 29. Further, the bill B after the first-stage and second-stage squeezing is subjected to the third-stage squeezing by the pressure roller 31 and the conveying roller 37. Thus, when folding is present in the bill B to be conveyed to the gradually narrowed conveying path, the three-stage squeezings can allow the folding to be further deeply folded to render the bill B flat or the folding to be returned to the original state to render the bill B flat. When the bill B conveyed to the gradually narrowed conveying path is a bill B bent in Y-axis direction, the three-stage squeezings can allow the bending to be corrected to render the bill B flat. Thus, the thickness of the folded bill B or the bent bill B can be minimized by the three-stage squeezings. Thus, jamming of the bill B within the BV 4 in receiving bills can be prevented. This in turn prevents the stop of account activity derived from the occurrence of jamming of the bill B within the BV 4.

When the bill B in receiving bills is in the state of being satisfactorily squeezed by the first-stage and second stage squeezing to such an extent that jamming does not occur within the BV 4 and the bill B is satisfactorily flatten, the third-stage squeezing in receiving bills can be omitted.

The folded bill B that has been further deeply folded to be rendered flat is sometimes determined to be invalid by the validation in the BV 4. Since, however, as described above, the bill B that has been determined to be invalid by the validation as such is returned to the bill receiving/dispensing port 2, there is no possibility that the account activity is stopped due to the bill B that has been further deeply folded to be rendered flat.

Operation in Dispensing Bills

The bill B that has been introduced into and stored in the recycle stackers 5-1 to 5-4 in receiving bills is already in the state of being rendered flat by the above three-stage squeezings. In dispensing bills, the flatly shaped bill B is conveyed by the conveying belt 51 into between the squeezing roller 47 and the conveying roller 41 that constitute a pair of rollers. The bill B is then held between the squeezing roller 47 and the conveying roller 41 and, is pressed for the "first-stage squeezing" in dispensing bills. That is, the squeezing roller 47 and the conveying roller 41 correspond to a "fourth squeezing unit" that performs the "first-stage squeezing" against the bill B in dispensing bills.

The bill B that has been subjected to the first-stage squeezing is conveyed by the conveying belt 43 and is guided by the conveying guide 49 into between the squeezing roller 45 and the conveying roller 39 that constitute a pair of rollers. The bill B is then pressed while being held between the squeezing roller 45 and the conveying roller 39 for the "second-stage squeezing" in dispensing bills. That is, the squeezing roller 45 and the conveying roller 39 correspond to a "fifth squeezing unit" that performs the "second-stage squeezing" against the bill B in dispensing bills.

Thus, in the bill handling apparatus 3, the bill B in dispensing bills is conveyed into the BV 4 after squeezing by the fourth squeezing unit and the fifth squeezing unit. Thus, when the bill B in dispensing bills is conveyed into the BV 4, the bill B is in the state of being further deeply shaped to a more flat form as compared with when the bill B is received. Therefore, the occurrence of jamming of the bill B within the BV 4 in dispensing bills can be prevented.

As described above, since the bill B in dispensing bills is already in the state being flatly shaped in receiving bills, squeezing against the bill B in dispensing bills can be omitted, for example, when simplification of the structure of the bill handling apparatus 3 is contemplated.

According to the disclosed aspect, it is possible to prevent the occurrence of jamming of the bill within BV.

All examples and conditional language recited herein are intended for pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although the embodiment of the present invention has been described in detail, it should be understood that the various changes, substitutions, and alterations could be made hereto without departing from the spirit and scope of the invention.

What is claimed is:

1. A bill handling apparatus comprising:

a first squeezing unit that includes a pair of conveying belts that convey the bill in a predetermined conveying direction in receiving the bill to perform a first squeezing of a bill in receiving the bill;

a second squeezing unit that includes a pair of rollers to perform a second squeezing of the bill after the first squeezing in receiving the bill;

a third squeezing unit that includes a pair of rollers to perform a third squeezing of the bill after the first and second squeezing in receiving the bill;

a fourth squeezing unit that includes a pair of rollers to perform a fourth squeezing of the bill in dispensing the bill conveyed in a direction opposite to the predetermined conveying direction;

a fifth squeezing unit that includes a pair of rollers to perform a fifth squeezing of the bill after the fourth squeezing in dispensing the bill; and a bill validator that validates the bill in receiving the bill that has been subjected to the first, second and third squeezings and validates the bill in dispensing the bill that has been subjected to the fourth and fifth squeezings, wherein a distance between both the conveying belts included in the first squeezing unit is gradually reduced in a direction of thickness of the bill in the predetermined conveying direction, the pair of conveying belts included in the first squeezing unit having a "V" shape in the direction of thickness of the bill in the predetermined conveying direction, the pair of rollers included in the second squeezing unit are disposed at an apex of the "V" shape of the pair of the conveying belts included in the first squeezing unit, and the number of squeezings performed before the validating by the bill validator in dispensing the bill is less than the number of squeezings performed before the validating by the bill validator in receiving the bill.

2. The bill handling apparatus according to claim 1, wherein, in a longitudinal direction perpendicular to the predetermined conveying direction, an area of contact between each of the pair of rollers and the bill is extended over a whole area in a longitudinal direction of the bill.

3. The bill handling apparatus according to claim 1, further comprising a guide that guides the bill into between the pair of rollers.

* * * * *